US006435446B1

(12) United States Patent
Matsuzawa

(10) Patent No.: US 6,435,446 B1
(45) Date of Patent: Aug. 20, 2002

(54) ROLL SHEET CONVEYING DEVICE AND RECORDING APPARATUS

(75) Inventor: Kunihiko Matsuzawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/570,688

(22) Filed: May 12, 2000

(30) Foreign Application Priority Data

May 14, 1999 (JP) ..... 11-134498

(51) Int. Cl.[7] ..... B65H 23/06; B65H 18/10; B65H 16/02; B65H 20/02

(52) U.S. Cl. ..... 242/422.4; 242/534; 242/545; 242/545.1; 242/563; 242/564.4

(58) Field of Search ..... 242/422.4, 534, 242/535.3, 545, 545.1, 563, 564.4, 355.1; 399/375, 384–387, 391

(56) References Cited

U.S. PATENT DOCUMENTS 3,974,974 A * 8/1976 Nishikawa ..... 242/422.4
4,316,586 A * 2/1982 Mocco ..... 242/535.3
4,466,579 A * 8/1984 Nitsch et al. ..... 242/422.4
4,469,291 A * 9/1984 Treiber et al. ..... 242/535.3
5,602,636 A 2/1997 Matsuzawa ..... 399/388
5,758,840 A * 6/1998 Murakami ..... 242/564.4
5,933,697 A 8/1999 Onodera et al. ..... 399/406

* cited by examiner

*Primary Examiner*—John M. Jillions
(74) *Attorney, Agent, or Firm*—Fitzpatrick, Cella, Harper & Scinto

(57) ABSTRACT

A roll sheet conveying device includes a spool arranged to be rotatable while holding a roll-shaped sheet, a sheet conveying roller for driving and conveying the sheet, and a spool brake mechanism for generating a rotation load to act on the spool, wherein, when the sheet is sent out from the spool by driving the sheet conveying roller, the rotation load of the spool brake mechanism is caused to act on the spool, and when the sheet is rewound onto the spool by driving the spool, the rotation load of the spool brake mechanism is prevented from acting on the spool.

17 Claims, 10 Drawing Sheets

ROLL SHEET CONVEYING DEVICE AND RECORDING APPARATUS

BACKGROUND OF THE INVENTION

1. Field of the Invention

The present invention relates to a roll sheet conveying device adapted for use in a recording apparatus or the like, such as a printer, a facsimile equipment or a copying machine, using a sheet, such as a roll of paper or a roll of film.

2. Description of Related Art

Known recording apparatuses arranged to record an image on a roll-shaped recording medium (sheet), such as recording paper or film, while conveying the roll-shaped recording medium are generally arranged as follows.

FIG. 12 shows a sheet conveying path of a recording apparatus of the above-stated kind. Roughly speaking, the recording apparatus is composed of a roll sheet holder 100 arranged to rotatably hold a roll sheet Pr so as to feed the paper of the roll sheet Pr for recording, a sheet conveying part 110 arranged to convey the roll sheet Pr to an image forming part 130, the image forming part 130 arranged to form an image on the roll sheet Pr while holding the roll sheet Pr sent out from the sheet conveying part 110, a sheet delivery part 140 arranged to deliver the sheet after image formation to the outside of the apparatus, and a manual-feed conveying part 120 arranged to feed and convey a manually-fed cut sheet to the image forming part 130.

The roll sheet Pr is rotatably held within the roll sheet holder 100 through a spool 101, and is set within the roll sheet holder 100 with the fore end part of the roll sheet Pr pinched or nipped between paper feed rollers 103 (the fore end of the roll sheet Pr being located at a position A).

A recording operation begins with a sending-out action on the roll sheet Pr. The paper feed rollers 103 first rotate to move the fore end (leader) part of the roll sheet Pr out from the roll sheet holder 100. After that, upon arrival of the fore end part of the roll sheet Pr at the sheet conveying part 110, the roll sheet Pr is conveyed to the image forming part 130 by the conveying force of conveying rollers 111 and the guide of a pair of guides 113 and another pair of guides 114. The roll sheet Pr is then wrapped around the surface of a conveying roller 131 to be further conveyed. The conveying action on the roll sheet Pr comes to a stop a predetermined period of time after the fore end of the roll sheet Pr passes a sheet delivery roller 141.

An image forming action next begins. An image is formed by an image recording head 135 on the roll sheet Pr with the sheet held on a platen 134. Upon completion of the image forming action, the roll sheet Pr is cut by a cutter 142 when a part of the roll sheet Pr where the image is formed reaches a path part located on the lowerstream side of the cutter 142. With the roll sheet Pr thus cut, the image-formed part of the roll sheet Pr (an image bearing sheet) is delivered to the outside of the recording apparatus, for example, by its own weight.

The recording apparatus of the kind mentioned above, however, has presented the following problems. In starting the next image forming process continuously after one image-formed portion of the roll sheet has been cut, the fore end margin of the next image becomes too wide as much as a length C as shown in FIG. 12. Therefore, the roll sheet cannot be considered to be effectively used.

In order to avoid this, the roll sheet Pr must be pulled back to set its fore end near to a nipping part of the sheet delivery roller 141. Further, in the event of an attempt to convey a cut sheet by manually inserting it after image recording on the roll sheet Pr, a portion of the roll sheet wrapped around the conveying roller 131 hinders this attempt. To avoid this, the roll sheet must be pulled back (rewound) at least to a position where its fore end is on the upperstream side of a point of confluence B of the roll sheet path and the manual-feed sheet path.

Further, to facilitate replacing work on the roll sheet, the apparatus of this kind generally has the roll sheet holder 100 arranged to be drawn out from the body of the apparatus. In that case, if the roll sheet holder 100 is drawn out while the roll sheet is in a state of having been moved out from the roll sheet holder 100, the fore end of the roll sheet would remain inside of the apparatus. Under such a condition, the replacing work on the roll sheet would become very difficult.

Then, in order to avoid this trouble, the fore end of the roll sheet must be moved back to the position A within the roll sheet holder 100 before the roll sheet holder 100 is drawn out from the body of the apparatus.

For this purpose, the apparatus must be provided with a roll sheet pullback mechanism. The roll sheet pullback mechanism is arranged to drive and rotate the conveying rollers 103, 111 and 131 in a direction reverse to the direction of sending out the roll sheet.

However, the pullback action of the roll sheet pullback mechanism necessitates a space for allowing a redundantly pulled-back portion of the roll sheet Pr to slacken within the roll sheet holder 100, as indicated with a two-dot-chain line in FIG. 12. That arrangement increases the size and weight of the roll sheet holder 100, and thus increases the size of the apparatus.

It is conceivable to solve this problem by a method of driving the spool 101 concurrently with the pullback action to wind and take up the redundantly pulled-back portion of the roll sheet Pr onto the roll of sheet. The roll-sheet winding speed, however, varies with the roll (coil) diameter of the roll sheet. This problem may be solved by measuring the roll diameter and varying the spool driving speed according to the measured diameter to make the roll-sheet winding speed constant. However, this method necessitates use of a roll-diameter measuring mechanism, a discrete spool driving mechanism and a device for control over the spool driving speed. Such a method not only makes the structural arrangement of the apparatus complex but also causes an increase in cost.

According to another conceivable method which is simpler than the above-stated method, the amount of slack of the roll sheet is measured and the roll sheet is wound up for a predetermined period of time. However, that method also necessitates use of some additional detecting mechanism.

While these methods have the above-stated shortcoming, the problem can be simply solved by setting the spool driving speed at a relatively high speed and by arranging a slip mechanism, within a spool driving mechanism, to have a slip caused to take place by a tension developed when the roll sheet is stretched beyond a prescribed torque. However, it is difficult to set the prescribed torque, because of the following reasons.

When the roll sheet is pulled out from its roll by means of the conveying roller, the roll sheet is caused to obliquely travel even by a slight unevenness of the conveying force of the conveying roller in the direction of the width of the roll sheet and/or by a slight degree of discrepancy between the axis of the roll and that of the shaft of the conveying roller.

In order to prevent the oblique travel of the roll sheet, it is necessary to apply some rotation load (roll sheet brake) to the roll sheet. The greater the braking force, the larger the effect of preventing the oblique travel is. However, in rewinding the roll sheet, the spool must be driven while overcoming the rotation load, so that the setting value of the slip torque of the spool must be increased to greater than the rotation load.

Such an arrangement causes an increase in the driving load, and thus results in unsteadiness in speed and amount of transport of the roll sheet and also in increases in size and power consumption of the motor.

Further, a problem with the spool rewinding method lies in that, in the event of occurrence of a slip between the roll sheet and its roll core, an idle rotation of the roll core takes place to eventually bring about slacking of the sheet within the roll sheet holder.

This slip takes place in cases where the roll sheet is not firmly attached to the roll core with some adhesive or the like at the beginning of winding the roll. However, such cases are not rare. Therefore, to ensure the reliability of the apparatus, the apparatus must be arranged to be capable of adequately coping with such a trouble.

BRIEF SUMMARY OF THE INVENTION

It is an object of the invention to provide a roll sheet conveying device arranged to be capable of always stably performing a rewinding action on the roll sheet, while effectively preventing the roll sheet conveying device from becoming larger in size and complex in structure and from lowering the reliability thereof.

To attain the above object, in accordance with an aspect of the invention, there is provided a roll sheet conveying device, comprising a spool arranged to be rotatable while holding a roll-shaped sheet, sheet conveying means for driving and conveying the sheet, and load generating means for generating a rotation load to act on the spool, wherein, when the sheet is sent out from the spool by driving the sheet conveying means, the rotation load of the load generating means is caused to act on the spool, and when the sheet is rewound onto the spool by driving the spool, the rotation load of the load generating means is prevented from acting on the spool or is caused to lessen to act on the spool.

More specifically, a roll sheet conveying device comprises a spool rotatably supported within a roll sheet holder in a state of holding a roll sheet from inside of a roll core on which the roll sheet is wound, one or more conveying rollers arranged to convey the roll sheet, a driving mechanism arranged to drive and rotate at least one of the spool and the one or more conveying rollers, a rotating direction of the driving mechanism being changeable to change over between conveying modes of conveying the roll sheet in a sending-out direction and in a rewinding direction, and a spool brake mechanism for applying a braking force to the rotation of the spool, wherein, when the roll sheet is sent out from the spool by driving the one or more conveying rollers, the braking force of the spool brake mechanism is caused to act on the spool, and, when the roll sheet is rewound onto the spool by driving the spool, the braking force of the spool brake mechanism is prevented from acting on the spool.

Thus, when the roll sheet is sent out from the spool (i.e., when the roll sheet is unrolled from its roll while causing the spool to rotate through the roll sheet by the driving force of the sheet conveying means), the sheet is prevented from obliquely traveling by causing the rotation load (i.e., the braking force) to act on the spool. On the other hand, when the roll sheet is rewound onto the spool (i.e., when the unrolled sheet is wound back on the roll by the driving force of the spool), an increase of the load on the winding driving is prevented by preventing the rotation load (i.e., the braking force) from acting on the spool.

As for the above-stated change-over, a one-way clutch or the like is employed to connect the spool to the load generating means in sending out the roll sheet and to disconnect the spool from the load generating means in rewinding the roll sheet.

Further, in a case where the roll sheet conveying device according to the invention is provided with a driving mechanism for driving the spool and the sheet conveying means in rewinding the roll sheet, the driving mechanism is arranged to drive the spool at such a speed that a speed at which the roll sheet is taken up onto the spool by the spool and a roll of the roll sheet wound on the spool becomes higher than a driving speed of the sheet conveying means in the rewinding direction throughout the whole process of rewinding the roll sheet. The roll sheet conveying device may be provided further with slip means, such as a torque limiter, arranged to cause the spool to slip over the driving mechanism when the spool receives from the sheet a rewinding resisting force of a value exceeding a predetermined value.

The above-stated arrangement enables the roll sheet conveying device to rewind the roll sheet without slackening it. The size of the roll sheet holder by which the sheet roll is held through the spool thus can be prevented from increasing. Besides, since the load on the sheet rewinding driving action can be prevented from increasing, the latitude of setting a slip generating torque for the slip means is increased and the absolute value of the slip generating torque can be lessened.

Further, in a case where the roll sheet conveying device according to the invention has the spool arranged to hold the core member of the roll sheet, the roll sheet conveying device may be provided with control means which is arranged to detect whether or not a slip takes place between the sheet and the core member in at least one of sending out the roll sheet and rewinding the roll sheet and, upon detection of the slip, to restrain driving of at least one of the sheet conveying means and the spool.

Such control means enables the roll sheet conveying device to effectively prevent the roll sheet from slackening due to a slip taking place between the roll sheet and the core member.

The arrangements according to the invention described above are advantageous particularly for a roll sheet conveying device wherein spools are arranged vertically in a multi-stage manner.

The above and other objects and features of the invention will become apparent from the following detailed description of preferred embodiments thereof taken in connection with the accompanying drawings.

DETAILED DESCRIPTION OF THE INVENTION

Hereinafter, preferred embodiments of the invention will be described in detail with reference to the drawings.

(First Embodiment)

Figure 1:
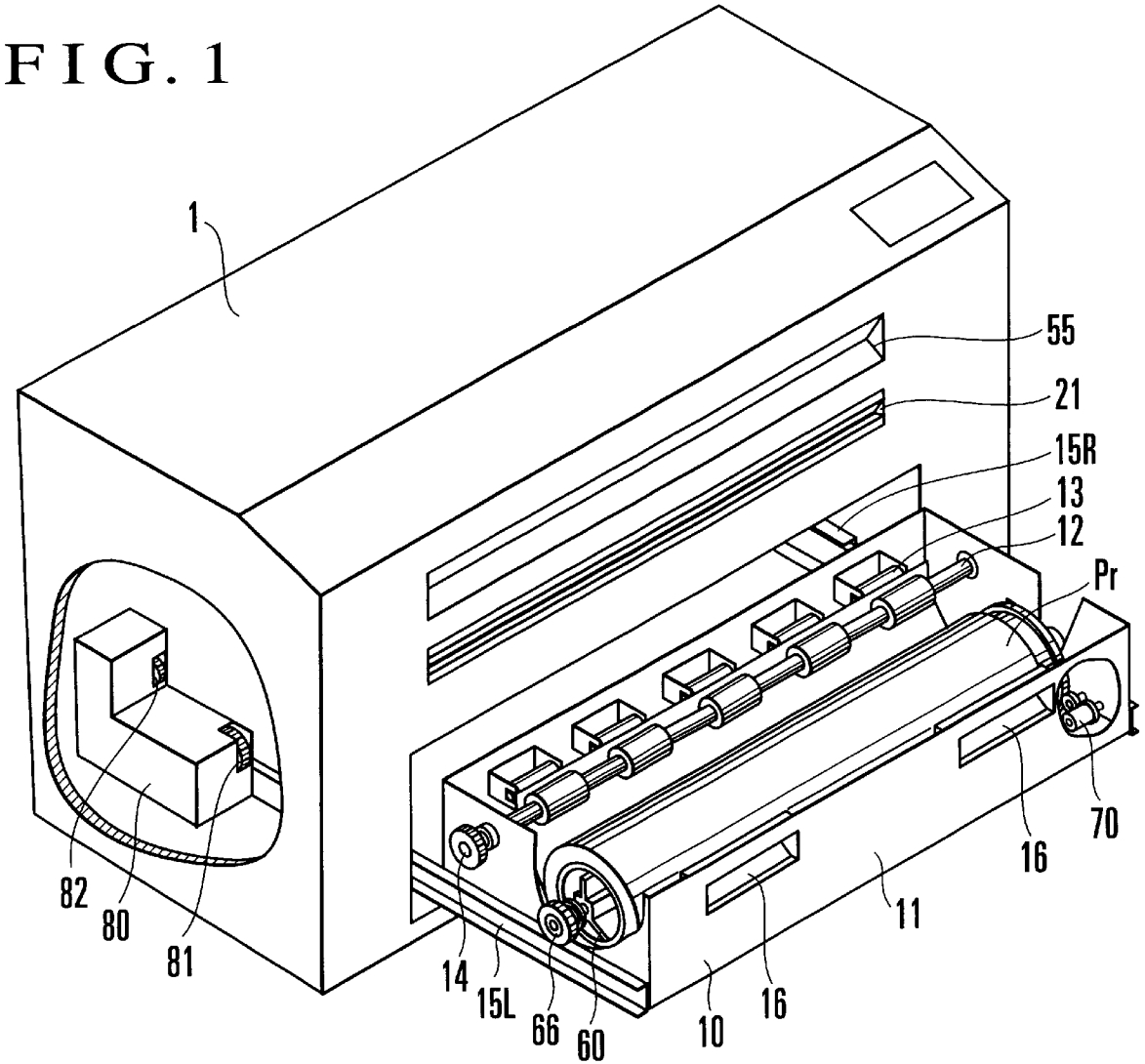
FIG. 1 is a perspective view showing the entirety of a recording apparatus according to a first embodiment of the invention.
Figure 2:
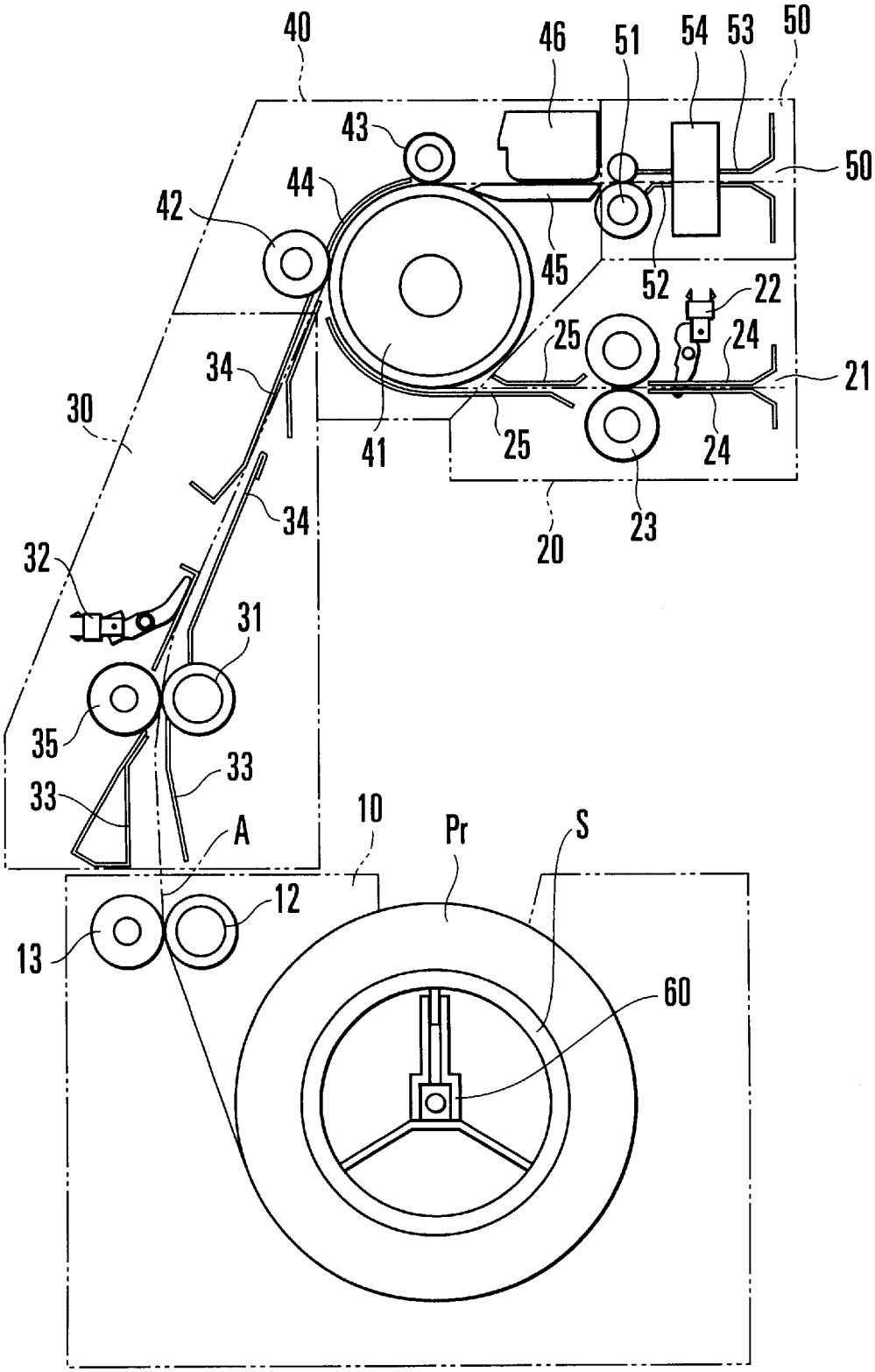
FIG. 2 is a sectional view showing a sheet conveying path arranged inside the recording apparatus shown in FIG. 1.

FIGS. 1 and 2 show a recording apparatus which is provided with a roll sheet conveying device according to a first embodiment of the invention. In particular, FIG. 1 shows the appearance of the recording apparatus, and FIG. 2 shows a sheet conveying path arranged in the recording apparatus. The recording apparatus according to the first embodiment employs the so-called ink jet type recording method whereby a recording head is arranged to make a reciprocating motion and a (recording) sheet is arranged to be intermittently fed to a prescribed extent in synchronism with the reciprocating motion of the recording head.

Roughly speaking, the recording apparatus is composed of a body 1, a roll sheet holder 10 arranged to rotatably hold a roll sheet Pr, which is paper or the like, so as to feed the roll sheet Pr, a roll sheet conveying part 30 arranged to convey the roll sheet Pr being payed out from its roll to an image forming part 40, the image forming part 40 arranged to form an image on the roll sheet Pr while holding the roll sheet Pr sent out from the roll sheet conveying part 30, a sheet delivery part 50 arranged to deliver, to the outside of the recording apparatus, the sheet after the image forming process, a manual-feed sheet conveying part 20 arranged to feed and convey a cut sheet to the image forming part 40, and a roll sheet driving unit 80.

The roll sheet holder 10 is composed of a spool 60 which is arranged to support a core tube (core member) S of the roll of the roll sheet Pr from the inside thereof, a frame 11 arranged to rotatably support the two ends of the spool 60, a roll sheet conveying roller (sheet conveying means) 12 arranged to convey the roll sheet Pr from the roll sheet holder 10, and a driven roller 13.

The roll sheet holder 10 can be drawn out from the body 1 of the recording apparatus along slide rails 15R and 15L, so that the roll sheet Pr can be replaced without difficulty.

A roller gear 14 is secured to the end of the roll sheet conveying roller 12 and is arranged such that, when the roll sheet holder 10 is mounted on the body 1, the roller gear 14 is in mesh with a roller driving gear 82 of the roll sheet driving unit 80 disposed inside of the recording apparatus. The roll sheet holder 10 is provided with hand-hold parts 16 for drawing out the roll sheet holder 10.

A spool brake mechanism (load generating means) 70 is disposed within the roll sheet holder 10. The spool 60 and the spool brake mechanism 70 are arranged as described in detail later herein.

The roll sheet conveying part 30 is composed of an intermediate conveying roller 31, a sheet sensor 32, conveying guides 33 and 34, and a driven roller 35.

The manual-feed sheet conveying part 20 is composed of a manual-feed port 21, a sheet sensor 22, a manual-feed sheet conveying roller 23, and conveying guides 24 and 25. The recording apparatus thus permits use of either of two different recording media including the roll sheet and the cut sheet.

The image forming part 40 includes a sub-scanning roller 41 which is arranged to convey the recording sheet to a predetermined extent in forming an image thereon. In the case of the present recording apparatus, the recording sheet conveying action to be performed while the image recording is in process is called a sub-scanning. The image forming part 40 further includes driven rollers 42 and 43, a conveying guide 44, a platen 45 for flatly holding the recording sheet, and an image recording head 46 arranged to record an image on the sheet held on the platen 45.

The recording head 46 is arranged, according to the ink jet method, to make a reciprocating motion in a direction which is perpendicular to the sheet conveying direction during the process of recording. In the case of the present recording apparatus, the reciprocating motion of the recording head 46 is called a main scanning. A head driving signal is formed on the basis of image data formed in synchronism with the scanning action. Then, in accordance with the head driving signal, the recording head 46 forms an image on the sheet by emitting ink drops toward the sheet.

The sub-scanning roller 41 is arranged to convey the sheet to a predetermined extent during each scanning period of the recording head 46. However, since the quality of an image greatly dependents on the accuracy of this sheet conveying action, the sub-scanning roller 41 is finished with a high degree of precision with respect to the outside diameter thereof and the deflecting amount thereof. In addition to that, the coefficient of friction of the roller surface is enhanced by sand-blasting or the like to prevent slipping of the sheet as much as possible.

The sub-scanning roller 41 is driven by a sub-scanning driving motor (not shown). Further, the sub-scanning driving motor is arranged to drive not only the sub-scanning roller 41 but also the conveying roller 31, the manual-feed sheet conveying roller 23 and a sheet delivering roller 51.

With regard to the conveying roller 31 and the manual-feed sheet conveying roller 23, however, they are selectively driven under the control of a clutch (not shown) according to whether the recording sheet is a cut sheet or a roll sheet.

The sheet delivery part 50 is composed of the sheet delivering roller 51, sheet delivering guides 52 and 53, a cutter 54, and a sheet delivering port 55. The sheet conveying speed of the sheet delivering roller 51 is set to be higher by several percent than the conveying speed of the sub-scanning roller 41 in such a way as to prevent the sheet from slackening on the platen 45. The conveying force of the sheet delivering roller 51 is arranged to be smaller than that of the sub-scanning roller 41 in such a way as to cause the sheet to always slip on the side of the sheet delivering roller 51.

The details of the spool 60 are next described with reference to FIGS. 3(A) and 3(C). The spool 60 is formed with plate members 62*a,* 62*b* and 62*c* which are secured to the outside of a square type core rod 61 and arranged to support the core tube S of the roll sheet Pr by their fore ends which extend in three directions.

A link mechanism is arranged in a gap between the plate members 62*a* and 62*b* to fix the core tube S in place. The link mechanism is composed of a pressure spring 63*d,* a lever 63*a* which is swingably mounted on the plate members 62*a* and 62*b* and can be pushed in toward the axis of the spool 60 against the force of the spring 63*d,* a claw 63*c* which is mounted on the plate members 62*a* and 62*b* to be swingable between a position at which it protrudes from between the plate members 62*a* and 62*b* and a position at which it is retracted inward between the plate members 62*a* and 62*b,* and a link 63*b* which connects the lever 63*a* and the claw 63*c* to each other.

Figure 3A:
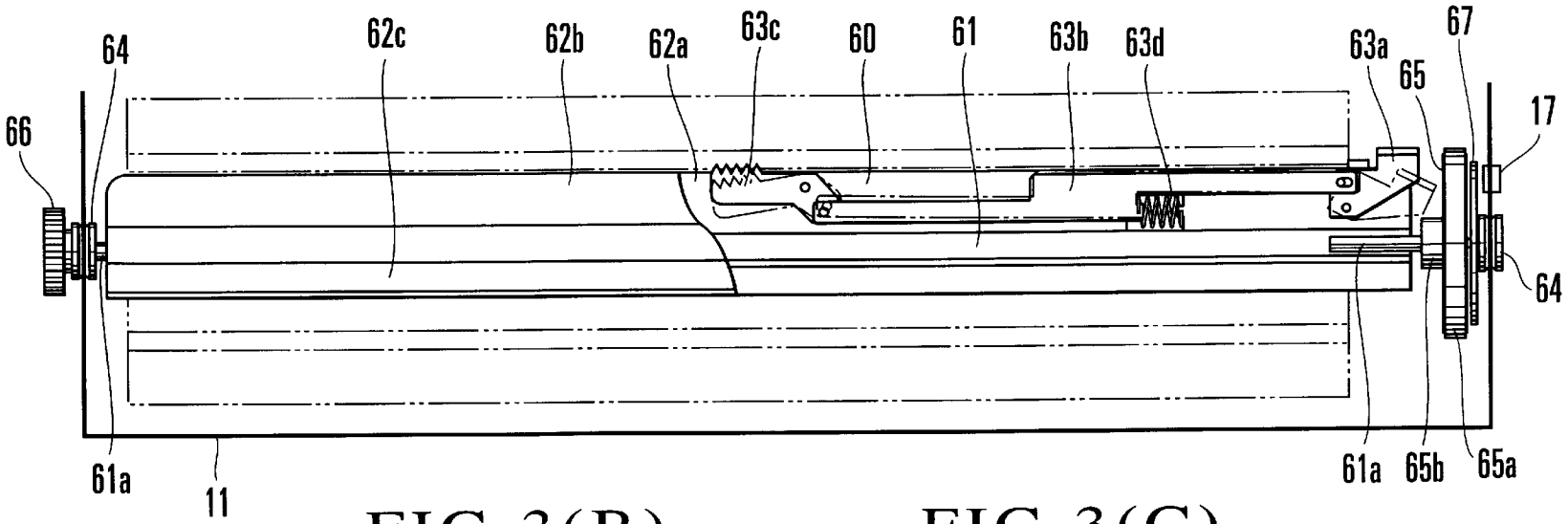
FIGS. 3(A), 3(B) and 3(C) show a spool mechanism arranged within the recording apparatus shown in FIG. 1 (and within another apparatus according to a second embodiment of the invention).
Figure 3C:
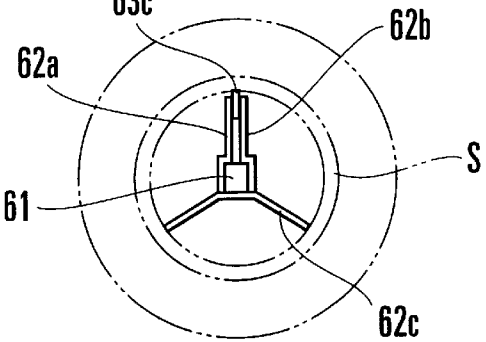

The spool 60 is inserted into the core tube S of the roll sheet Pr from the right side as viewed in FIG. 3(A) by pushing the lever 63*a* inward with a finger. When the finger is detached from the lever 63*a* with the spool 60 inserted, the urging force of the pressure spring 63*d* causes the claw 63*c* to protrude from between the plate members 62*a* and 62*b* and to stick in the inner side surface of the core tube S. By this, the spool 60 and the roll sheet Pr are unified into one body.

Round core rods 61*a* are inserted into both ends of the spool core rod 61. Both the round core rods 61*a* are rotatably held by the inner sides of bearings 64. The outer circumferential sides of the bearings 64 are fitted into grooves formed in the holder frame 11.

A spool ring 65 which is in contact with a driven ring 75 of the spool brake mechanism 70 is arranged at one of the round core rods 61*a* to be rotatable together with that round core rod 61*a*. The spool ring 65 is formed by wrapping the outer circumferential surface of a cylindrical member with a material 65*a* of a high coefficient of friction.

A spool gear 66 is secured to the end part of the other round core rod 61*a*. When the roll sheet holder 10 is set within the body 1 of the recording apparatus, the spool gear 66 is in mesh with a spool driving gear 81 of the roll sheet driving unit 80 shown in FIG. 1.

Figure 4:
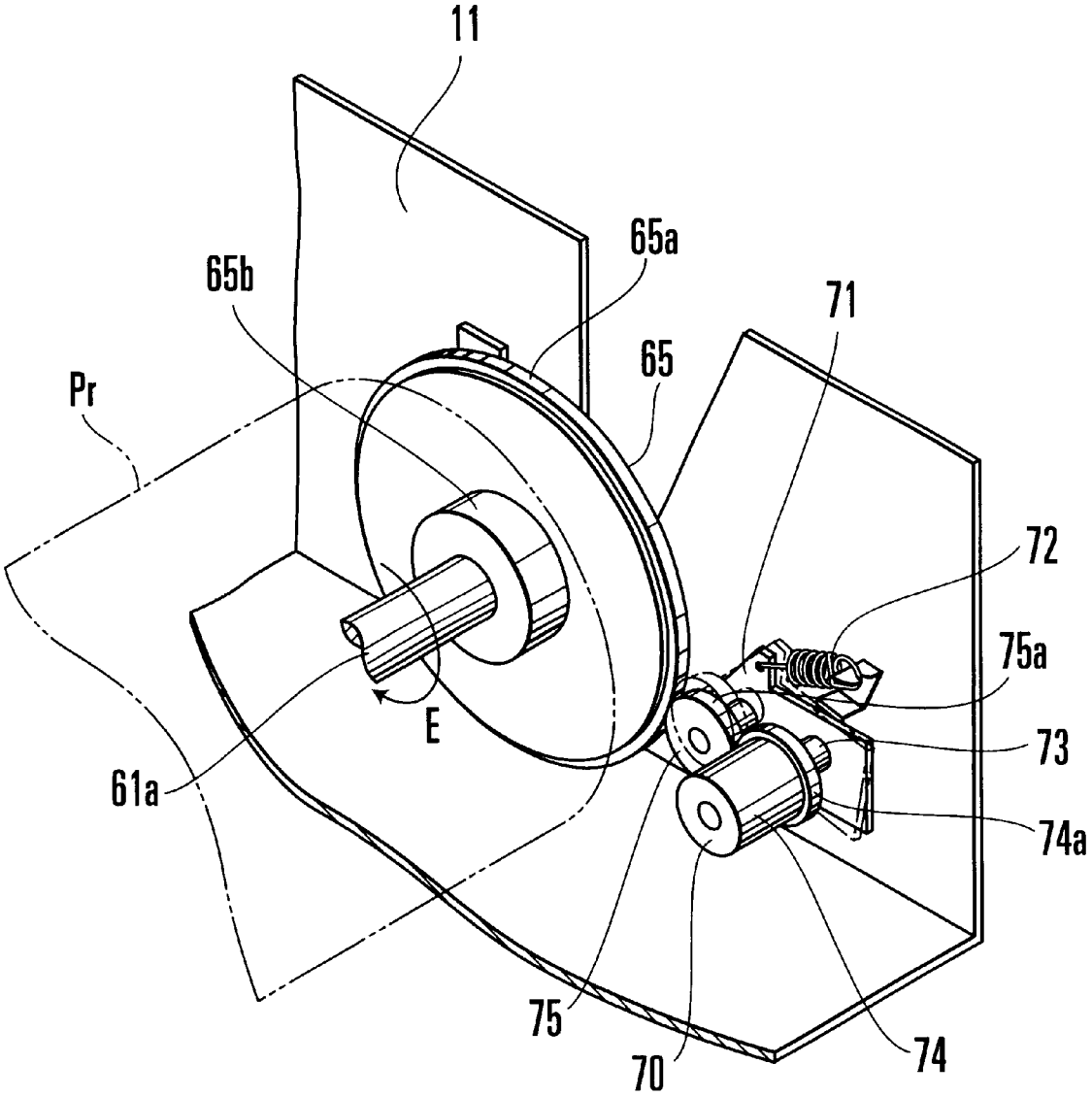
FIG. 4 is a perspective view showing the construction of a spool brake mechanism arranged to apply a braking force to the spool.

Next, the spool brake mechanism 70 is described with reference to FIG. 4. As shown in FIG. 4, a swingable plate 71 is mounted on a side surface of the roll sheet holder frame 11. The swingable plate 71 is biased upward by the urging force of an urging spring 72. A brake limiter 74 is mounted on a swing center shaft of the swingable plate 71. An input ring 74*a* is arranged to rotate at a predetermined torque caused by a frictional force generating mechanism arranged inside of the brake limiter 74. A driven ring 75 which is pushed against the input ring 74*a* is rotatably held by the swingable plate 71. A material of a high coefficient of friction, such as rubber, is applied to the input ring 74*a* and also to the outer circumferential surface 75*a* of the driven ring 75.

When the spool 60 is set in the roll sheet holder 10, the spool ring 65 comes into contact with the driven ring 75 to push the driven ring 75 downward against the urging force of the urging spring 72. This allows the rings 65, 75 and 74*a* to be frictionally driven when the spool 60 rotates. Then, the brake limiter 74 applies a rotation load (a braking force) to the spool 60 with a prescribed torque.

Here, the construction of the spool ring (connection member) 65 is described in further detail as follows. A one-way clutch (change-over means) 65*b* is interposed in between the spool ring 65 and the spool core rod 61*a*. The one-way clutch 65*b* is arranged to be in a locked state to cause the spool ring 65 and the spool core rod 61*a* to rotate together when the spool core rod 61*a* rotates in the direction of sending out the roll sheet Pr from the inside of the roll sheet holder 10 (in the direction of an arrow E), and to be in a free state to allow the spool ring 65 and the spool core rod 61*a* to rotate relative to each other when the spool core rod 61*a* rotates in the reverse direction.

In other words, the braking force of the brake limiter 74 is caused to act on the spool 60 in sending out or feeding the roll sheet Pr. The braking force of the brake limiter 74 is, however, not allowed to act on the spool 60 in rewinding the roll sheet Pr. The reason for this arrangement will be described later herein.

Figure 5:
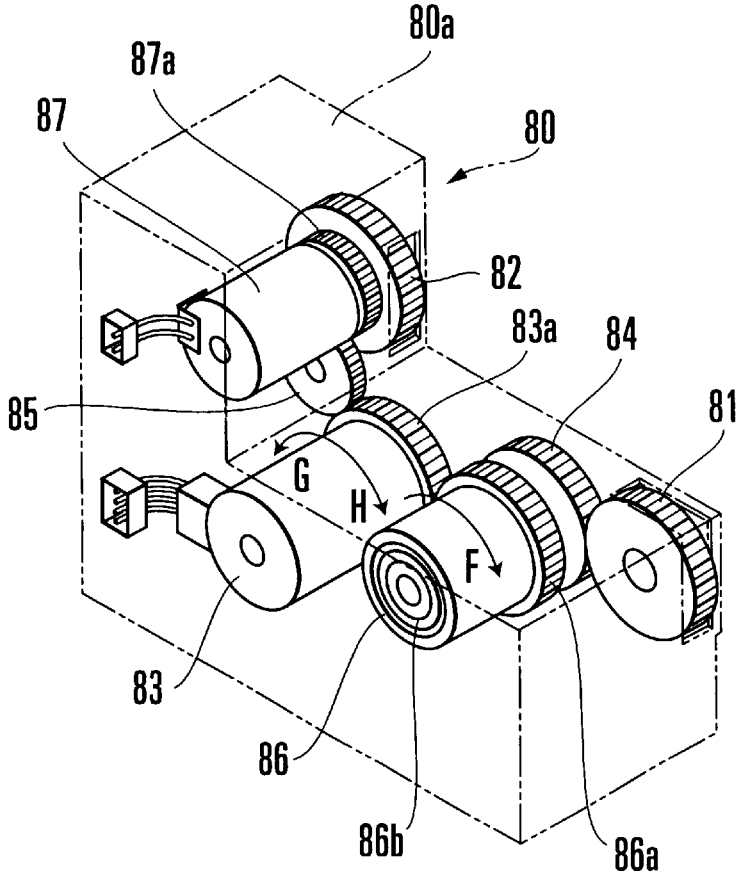
FIG. 5 is a perspective view showing the mechanism of a roll sheet driving unit arranged within the recording apparatus shown in FIG. 1.

Next, the roll sheet driving unit 80 is described with reference to FIG. 5. The roll sheet driving unit 80 is arranged to drive the spool 60 of the roll sheet holder 10 and the roll sheet conveying roller 12.

A roll sheet driving motor 83 is disposed within a drive frame 80*a* of the roll sheet driving unit 80. As regards the kind of the roll sheet driving motor 83, use of a DC servo motor or a stepping motor is preferable, because the driving speed of the motor 83 must be kept always constant.

The driving force of the roll sheet driving motor 83 is arranged to be transmitted from a motor gear 83*a* which is mounted on the output shaft of the motor 83 to a limiter gear 86*a* of a torque limiter 86 and further to the spool driving gear 81 through an idler gear 84. The driving force of the roll sheet driving motor 83 is also arranged to be transmitted from the motor gear 83*a* to the roller driving gear 82 through an idler gear 85 and a sheet-conveying-roller driving clutch gear 87*a*.

Figure 6:
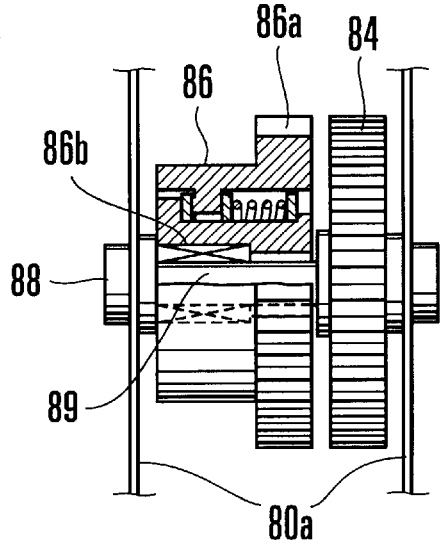
FIG. 6 is a partly-sectional side view showing the internal structure of a roll-sheet-winding torque limiter arranged within the recording apparatus shown in FIG. 1.

Here, the details of the torque limiter (slip means) 86 are described with reference to FIG. 6. Referring to FIG. 6, the torque limiter 86 is arranged on a center shaft 89 which is rotatably supported by the drive frame 80*a* through a bearing 88. The idler gear 84 is secured to the center shaft 89. The torque limiter 86 is mounted on the center shaft 89 through a one-way clutch (connecting/disconnecting means) 86*b*. The one-way clutch 86*b* is arranged to be in a free state when the limiter gear (input member) 86*a* rotates in the direction of an arrow F with the motor 83 rotating in the direction of sending out the roll sheet Pr, i.e., in the direction of an arrow G, and to be in a locked state to transmit the rotating force of the limiter gear 86*a* to the center shaft 89 when the limiter gear 86*a* rotates in the direction reverse to the direction of the arrow F with the motor 83 rotating in the direction of rewinding the roll sheet Pr, i.e., in the direction of an arrow H.

In other words, the driving force of the motor 83 is not transmitted to the spool gear 81 in sending out the roll sheet Pr. The driving force of the motor 83 is transmitted to the spool gear 81 at a prescribed torque set by the torque limiter 86 in rewinding the roll sheet Pr.

The transmission of a driving force from the motor 83 to the sheet conveying roller driving gear 82 is arranged to be selectively effected according to the connecting/disconnecting action of an electromagnetic clutch 87.

Here, the setting of a rotation speed is described. A relation in rotational frequency between the roller driving gear 82 and the spool driving gear 81 in rewinding the roll sheet is as follows. A roll winding speed at a minimum roll diameter (minimum winding speed) is arranged to be not lower than a sheet conveying speed by the roll sheet conveying roller 12, i.e., to be at least equal to a speed at which the roll sheet is conveyed by the roll sheet conveying roller 12.

The difference between the two driving speeds brings about some tension at the sheet between the roll sheet conveying roller 12 and the roll of the roll sheet. However, if the sheet tension becomes excessive due to an excessive difference between the two driving speeds, i.e., in the event of occurrence of a roll winding resisting force of a value larger than a predetermined value, a slip is caused to take place by the torque limiter 86 to absorb the excessive tension. Therefore, the roll sheet eventually can be wound up within a prescribed torque range.

Further, in feeding (sending out) the roll sheet, the spool 60 is not driven but is caused to rotate by the pulling-out movement of the roll sheet by the roll sheet conveying roller 12. At this time, the rotation of the spool 60 is transmitted to the center shaft 89 through the spool driving gear 81 and the idler gear 84. However, since the speed of the rotation of the center shaft 89 is slower than the speed of the rotation of the limiter gear 86*a* transmitted from the motor 83, the one-way clutch 86*b* is never locked.

The recording actions of the apparatus on the roll sheet are next described in sequence.

1) When an action start signal is issued from a computer terminal equipment or the like, a sequence of roll sheet sending-out processes is performed. First, the driving motor 83 within the roll sheet driving unit 80 is driven to rotate in the direction of the arrow G shown in FIG. 5 and, at the same time, the electromagnetic clutch 87 is energized, so that the roll sheet conveying roller 12 is driven to rotate. This causes the roll sheet Pr set within the roll sheet holder 10 to be sent out toward the image forming part 40. At this time, the driving force of the motor 83 is not transmitted to the spool driving gear 81, because the rotating direction of the limiter gear 86*a* within the roll sheet driving unit 80 is the idle rotating direction as mentioned above.

With the roll sheet Pr further sent out, the roll sheet Pr is conveyed by the rotation of the sub-scanning roller 41 and that of the intermediate conveying roller 31 to the roll sheet conveying part 30 and the image forming part 40. Then, the fore end of the roll sheet Pr comes to the sheet delivery part 50. When the fore end of the roll sheet Pr comes to be nipped by the sheet delivering roller 51, the roll sheet Pr ceases to be conveyed, so that the roll sheet sending-out action comes to an end.

2) In forming an image, the scanning action by the recording head 46 and the sheet conveying action by the sub-scanning roller 41 are alternately repeated to form an image on the sheet by the ink jet method. In this instance, only the sub-scanning roller 41 and the sheet delivering roller 51 are driven by the sub-scanning motor, and the driving clutch for the intermediate conveying roller 31 is not connected to the sub-scanning motor. If the intermediate conveying roller 31 is also driven and then there is any difference in conveying speed between the two rollers 41 and 31, the roll sheet Pr would slacken or would be excessively pulled to cause a bend of the sheet or a lowered accuracy of the conveying amount for sub-scanning, thereby degrading the image quality. This arrangement is made to prevent such trouble.

3) Upon completion of the image recording action, a sheet delivery action is performed. The sub-scanning roller 41 and the sheet delivering roller 51 are rotated to move the roll sheet in the direction of delivery to the outside of the recording apparatus. When an image bearing area of the roll sheet comes to the lowerstream of the cutter 54, the roll sheet is brought to a stop. Then, the cutter 54 is driven to cut the sheet.

The braking force obtained by the brake limiter 74 is acting on the spool 60 throughout the roll sheet sending-out action, the image forming action and the sheet delivery action, so that an oblique travel of the roll sheet can be adequately suppressed.

4) In performing a sheet rewinding action, both the clutch for driving the sheet conveying roller 31 and the electromagnetic clutch 87 are caused to be in connecting positions. The sub-scanning motor and the roll sheet driving motor 83 are reversely rotated (in the direction of the arrow H shown in FIG. 5) to drive the intermediate conveying roller 31, the sheet conveying roller 12 and the spool 60 to rotate in the direction of rewinding the roll sheet. By this, the sheet portions remaining at the sheet delivery part 50, the image forming part 40 and the roll sheet conveying part 30 are moved back to the inside of the roll sheet holder 10.

In this instance, the difference in driving speed between the sheet conveying roller 12 and the spool 60 and the action of the torque limiter 86 cause a prescribed amount of tension to act on the sheet portion between the sheet conveying roller 12 and the roll on the spool 60. The roll sheet Pr thus can be wound without slackening.

When the fore end of the roll sheet comes to pass the position of the sheet sensor 32, the lever of the sheet sensor 32 is displaced. When the displacement of the sensor lever is detected, the sheet rewinding action continues for a predetermined period of time until the fore end of the roll sheet reaches the position A within the roll sheet holder 10, i.e., a position where the fore end of the roll sheet is nipped by the sheet conveying roller 12 and the driven roller 13. After the lapse of this period of time, the sheet rewinding action comes to a stop. As mentioned above, the braking force of the spool brake mechanism 70 is not acting on the spool 60 while this sheet rewinding action is in process. Therefore, no unnecessary load is imposed on the rewinding driving action on the spool 60.

The advantages to be obtained in the first embodiment are described below with reference to FIG. 7.

Figure 7:
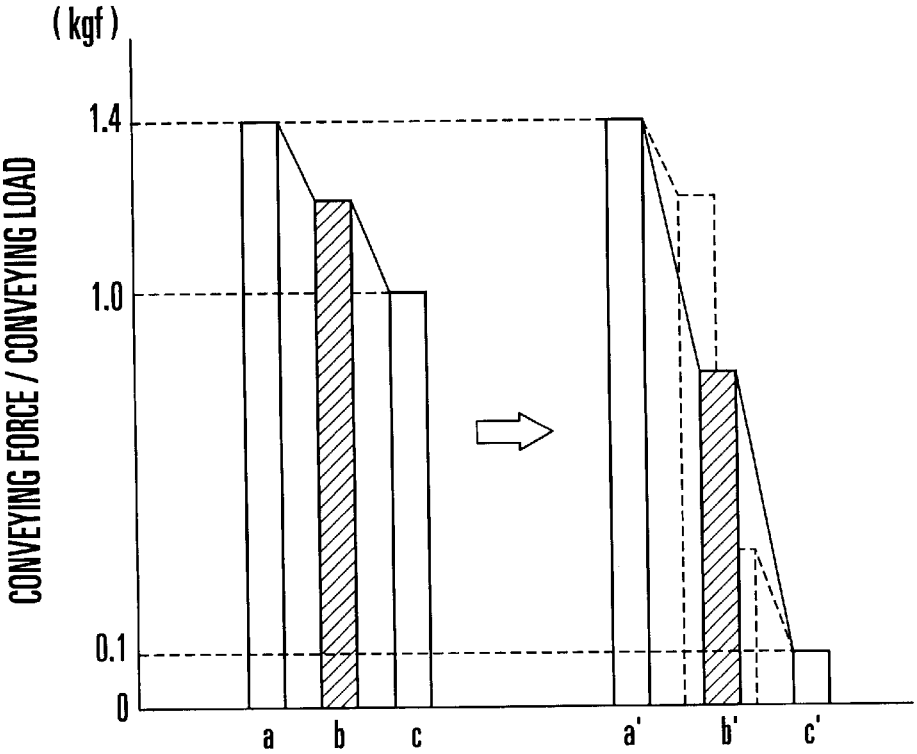
FIG. 7 is a graph showing the relationship among the conveying force of a roller, the setting value of the torque limiter and a load obtained in rewinding a roll sheet.

The left side of FIG. 7 shows a relation among a conveying force "a" of the sheet conveying roller 12, a braking force "c" for the spool 60 generated by the spool brake mechanism 70, and a force "b" (limiter value) obtained when the torque limiter 86 slips in rewinding the roll sheet, in a case where the braking force is applied to the spool 60 both in sensing out the roll sheet and in rewinding the roll sheet.

The right side of FIG. 7 shows a relation among a conveying force "a'" of the sheet conveying roller 12, a rotation load "c'" of the spool 60 obtained by the spool 60 itself, and a force "b'" (limiter value) obtained when the torque limiter 86 slips in rewinding the roll sheet, in a case where the braking force is applied to the spool 60 only in sending out the roll sheet, as in the case of the first embodiment.

In both cases shown on the left and right sides of FIG. 7, as a condition for deciding the value of the conveying force "a" of the sheet conveying roller 12 and the value of the braking force "c" generated by the spool brake mechanism 70, it is necessary to satisfy a condition of "a>c" to prevent the sheet conveying roller 12 from slipping as a result of being overcome by a brake load imposed thereon in sending out the roll sheet.

On the other hand, it is necessary to make the braking force "c" as large as possible for the purpose of preventing the sheet from obliquely traveling. Further, in respect of efficiency and loss of the apparatus, it is preferable to make both the absolute values of the two forces "a" and "c" as small as possible.

Taking all these things into consideration, it is considered to be appropriate to set the force "a" at 1.4 kgf and the force "c" at 1.0 kgf (a=1.4 kgf and c=1.0 kgf). Strictly speaking, the braking force "c" varies with the diameter of the roll. The value shown above is a maximum value decided in consideration of such variations.

In a case where the braking force "c" is allowed to act on the spool 60 also in rewinding the roll sheet, as shown on the left side of FIG. 7, the limiter value "b" must satisfy a condition of "a>b>c". In other words, if the limiter value "b" is not smaller than the conveying force "a" of the sheet conveying roller 12 in such a case, the sheet does not slip on the side of the spool 60 but slips at the nip part of the sheet conveying roller 12. Then, the slip at the nip part of the sheet conveying roller 12 brings about a change in the winding speed of the sheet according to the roll diameter and thus causes the fore end position of the sheet to vary and fluctuate when the sheet comes to a stop. In the event of such fluctuations of the stop position, if the fore end of the sheet has not yet passed through the sheet conveying part 30, the roll sheet would stick when the roll sheet holder 10 is pulled out from the body 1 of the apparatus. If the fore end of the sheet is rewound too much, on the other hand, the roll sheet comes off the sheet conveying roller 12 to hinder smooth execution of the next sending-out action. Further, if the limiter value "b" is not larger than the braking force "c", the torque limiter 83 would slip to prevent the spool 60 from rotating to wind the sheet thereon.

Therefore, the limiter value "b" must be set between 1.0 kgf and 1.4 kgf. With the manufacturing unevenness of parts and the stability of the recording apparatus taken into consideration, the range of the setting values becomes vary narrow.

In the case of the first embodiment, on the other hand, the one-way clutch 65*b* is arranged at the spool ring 65 to prevent the action of the braking force at the time of rewinding the roll sheet. Therefore, a lower limit value of the above condition becomes the rotation load c' of the spool 60 itself (0.1 kgf or thereabout), which is very small, as shown on the right side of FIG. 7. As a result, the setting range of the limiter value b' within the condition of "a'>b'>c'", which is to be satisfied in the first embodiment, becomes very wide. Broken lines in the right side part of FIG. 7 show the same rate of allowance given to the case represented by the right side part as that given to the case represented by the left side part. As apparent from FIG. 7, the allowance greatly increases in the case of the first embodiment represented by the right side part.

It is possible to broaden the setting range by increasing the conveying force "a" of the sheet conveying roller 12. However, since the absolute value of torque also can be lessened, compared with such a case, there is an advantage in the first embodiment that the rate of allowance to the driving system, etc., can be increased.

As described above, the first embodiment of the invention gives a greater amount of latitude for setting the torque of the torque limiter 86 without uselessly increasing the conveying force "a" of the sheet conveying roller 12 and also without lowering the oblique-travel correcting performance by lessening the braking force "c" on the spool 60 at the time of sending out the roll sheet. The allowable range for the manufacturing fluctuations of the apparatus and parts also can be broadened to enhance the reliability of the apparatus. Further, since the first embodiment necessitates no particularly complex mechanism, it has no demerit in terms of space and cost.

In the case of the first embodiment, the one-way clutch is arranged between the spool ring 65 and the spool 60. However, the invention is not limited to this arrangement. For example, if a space is available, a torque limiter with one-way mechanism may be arranged in the same manner as the spool driving torque limiter 86 which is disposed at the brake limiter 74. It is also conceivable to arrange the driven ring 75 and the spool ring 65 to be mutually touchable and detachable by automatically swinging the brake swinging plate 71 with a plunger or the like and to part the two from each other in rewinding the roll sheet.

Further, in the case of the first embodiment, the sheet conveying roller 12, the spool 60 and the driving motor 83 are arranged independently of the driving system including the sub-scanning driving motor. However, the arrangement may be changed to drive the sheet conveying roller 12 and the spool 60 by using the driving system of the sub-scanning driving motor.

With regard to the spool 60, a spool of a type different from the type of the spool 60 employed in the first embodiment may be used. For example, a spool arranged to hold the roll sheet by pushing flange-shaped parts into the core tube S from both ends of the roll sheet may be employed.

In a case where the rotation load "c'" in rewinding the roll sheet is very small, as in the case of the first embodiment described above, the rotation of the spool is apt to slightly fluctuate while the roll sheet is in process of rewinding, as the sheet repeatedly stretches and slackens due to the responsivity of the torque limiter and the elasticity of the roll sheet. This phenomenon is salient particularly immediate after the commencement of the sheet rewinding action. This phenomenon hinders the sheet from being stably wound up on the spool.

The detection accuracy of a slip detecting mechanism which is arranged to detect a slip taking place between the roll sheet and its core tube is also affected by the above-stated phenomenon. To solve the above problem, the roll sheet conveying device of the recording apparatus may be provided with another brake mechanism in such a manner as shown in FIG. 8.

Figure 8:
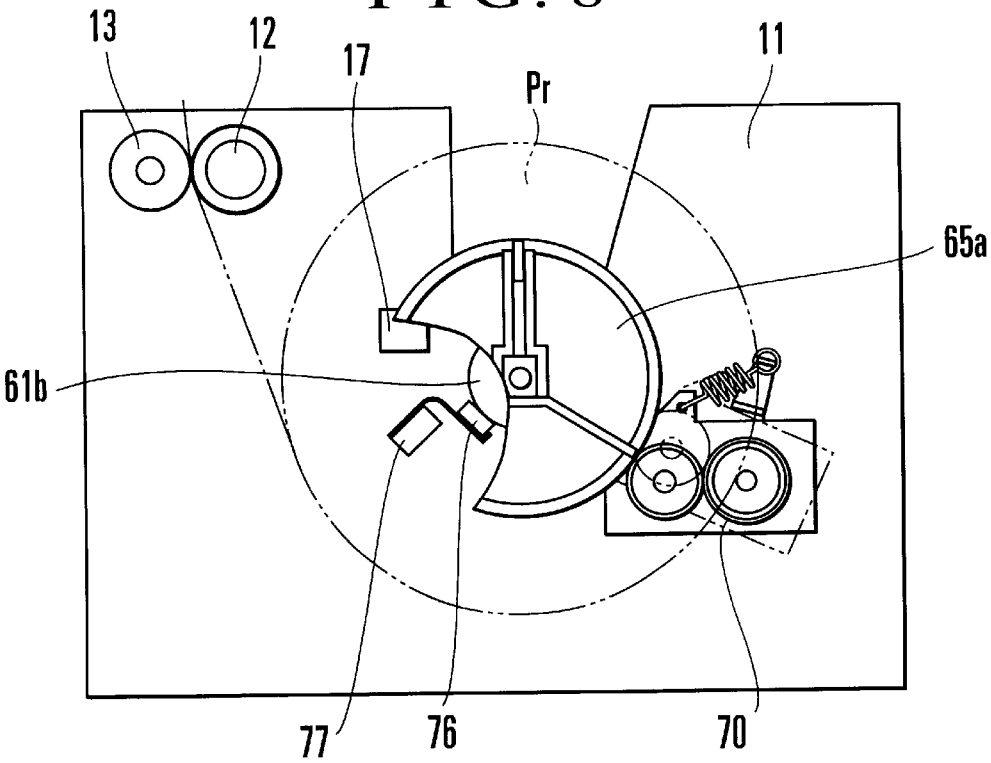
FIG. 8 shows the construction of the spool brake mechanism of the recording apparatus shown in FIG. 1.

Referring to FIG. 8, a brake flange 61*b* is unified with the spool 60 by attaching the brake flange 61*b* to the spool core shaft 61*a*. Meanwhile, a brake rubber 76 is provided on a leaf-spring-like brake holder 77 which has its one end secured to the holder frame 11. The arrangement is such that, when the spool 60 is set on the roll sheet holder 10, the flange 61*b* and the brake rubber 76 come in contact with each other. A pressing contact force of the brake rubber 76 is arranged to be generated by the flexure of the brake holder 77. With the exception of this brake mechanism, other parts of this modification are arranged in the same manner as the parts described in the foregoing.

Figure 9:
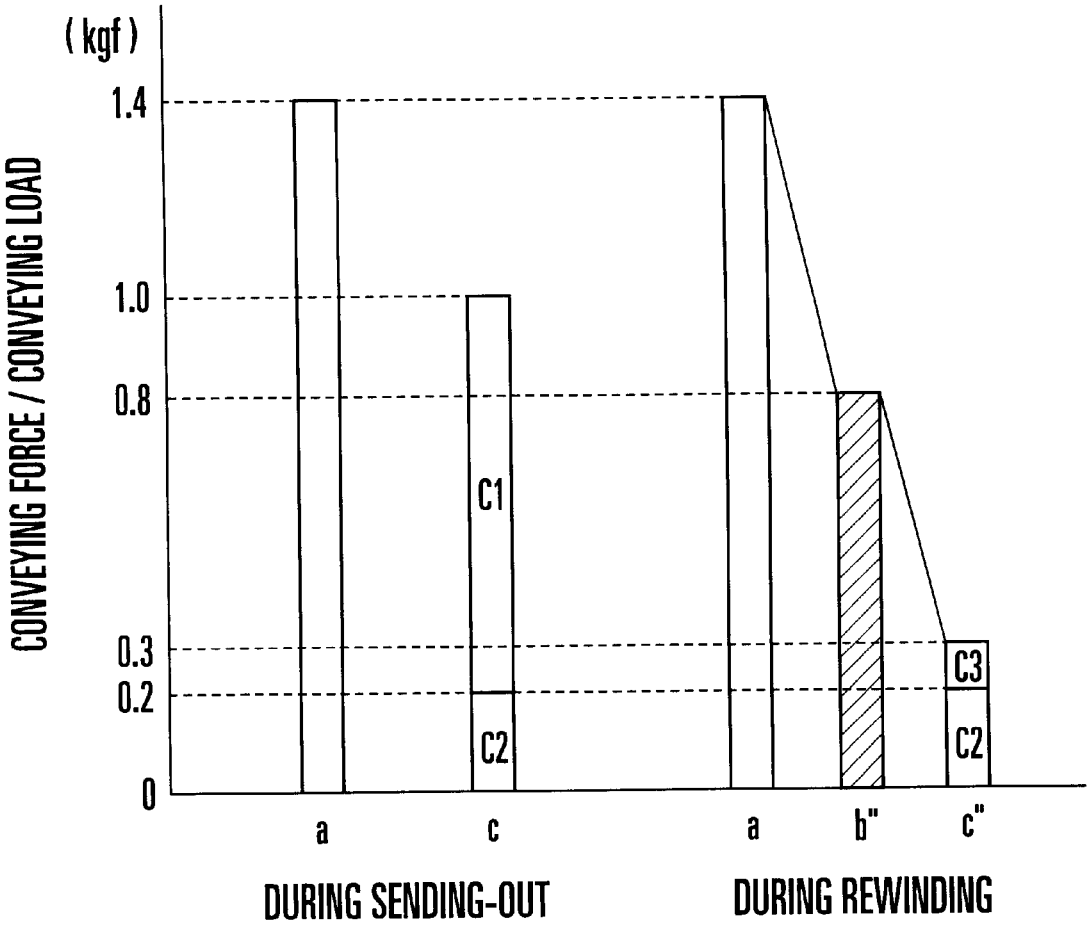
FIG. 9 is a graph showing the relationship between a conveying force and a conveying load in the recording apparatus shown in FIG. 1.

FIG. 9 shows a relation between a conveying force and a conveying load obtained by the above-stated arrangement. In feeding the roll sheet, the conveying force "a" of the conveying roller 12 is 1.4 kgf (a=1.4 kgf), which is the same as that of the case described in the foregoing, and the load "c" acting on the spool 60 is the sum of a value C1 obtained by the spool brake mechanism 70 and a value C2 obtained by the sliding frictional force of the brake rubber 76. More specifically, the values C1 and C2 are set as C1=0.8 kgf and C2=0.2 kgf, and, therefore, c=1.0 kgf.

In rewinding the roll sheet, on the other hand, a rotation load c" on the spool 60 becomes the sum of the above-stated value c' (0.1 kgf) and the frictional force C2 (0.2 kgf) of the brake rubber 76. In this case, the braking force obtained by the spool brake mechanism 70 does not act, in the same manner as described in the foregoing. In view of the above-stated relationship, a limiter value b" of the torque limiter 83 is set at 0.8 kgf.

In the above-stated arrangement, the setting range of the limiter value b" of the torque limiter becomes a little narrower than what is described in the foregoing. However, the reliability of the apparatus is never affected by the arrangement. Besides, the braking force C2 acts to stabilize the rotation of the spool to be made for rewinding the roll sheet. The sheet winding performance of the apparatus thus can be enhanced.

(Second Embodiment)

In the case of a roll sheet conveying device of the sheet rewinding type arranged as described in the foregoing to cause the core tube S of a roll sheet to rotate, it is important to note that the sheet and the core tube S might sometimes come to slip on each other.

For example, in a case where the winding start end of the roll sheet is not firmly attached to the core tube S, the tensile force of the roll sheet wound on the core tube S is apt to be overcome by the widening force of the sheet itself to bring about a slacken state when the remaining amount of the roll sheet decreases. In such a slacken state, it become impossible to take up and wind a payed-out portion of the roll sheet by rotating the core tube S in the sheet rewinding direction. Therefore, in order to ensure the reliability of the device, it is necessary to detect such a rewinding malfunction by some means.

In view of this necessity, the second embodiment is provided with a spool rotation detecting mechanism. The following describes the points of difference of the second embodiment from the first embodiment in connection with the detecting mechanism and its detecting method.

Figure 3B:
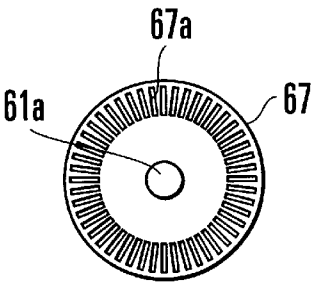

As shown in FIG. 3(B), a disk-shaped slit plate 67 is secured to the right-side core rod 61*a* of the spool 60. Slit-like holes 67*a* are formed in the slit plate 67 to extend at equal angles to be equally spaced in the direction of circumference of the slit plate 67. Meanwhile, as shown in FIG. 3(A), a reflection-type optical sensor (speed detecting means) 17 is arranged in a state of being opposed to the slit plate 67 on the right side surface of the roll sheet holder frame 11. By this arrangement, an electric pulse signal is formed and detected at a timing corresponding to the rotation speed of the spool 60.

By virtue of the above-stated arrangement, any sheet rewinding malfunction can be detected in the following manner. If there is no slip between the roll sheet and the core tube S, the rotation speed of the spool 60 varies with the roll diameter at that moment. The maximum (or minimum) value of the spool rotation speed becomes as follows. With the sheet conveying speed of the sheet conveying roller 12 assumed to be Vp (a constant value), the minimum (or maximum) winding diameter assumed to be Rmin (or Rmax), the maximum (or minimum) spool rotation speed is computed as "$\omega max=Vp/Rmin$" (or "$\omega min=Vp/Rmax$"). However, as mentioned in the foregoing, the spool driving rotation speed $\omega drive$ is set at a speed higher than $\omega max$ ($\omega drive=1.3\times\omega max$, in the case of the second embodiment). The difference between the two speed values is arranged to be absorbed by the slip caused by the torque limiter 86.

Therefore, in the event of occurrence of a slip between the roll sheet and the core tube S, the torque limiter 86 does not slip, allowing the spool 60 to rotate at the spool driving rotation speed $\omega drive$. This value of speed is always constant irrespective of the size of the roll diameter and cannot be obtained without the slip.

Figure 10:
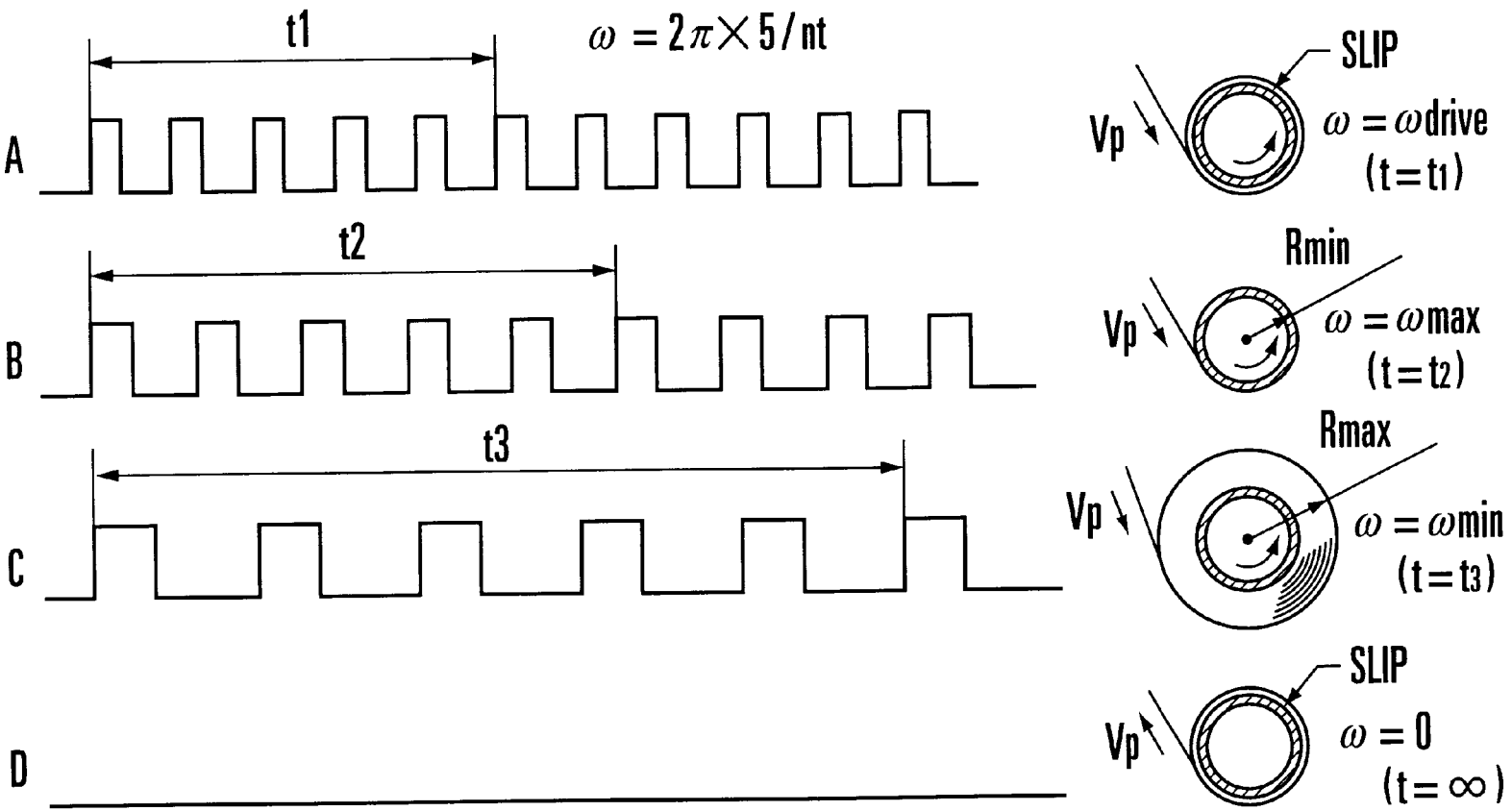
FIG. 10 is a schematic diagram showing the states of generation of pulses by a spool rotation detecting mechanism disposed in the recording apparatus shown in FIG. 1.

FIG. 10 schematically shows the above-stated situation. In FIG. 10, parts A, B and C respectively show the states of generation of pulses from the optical sensor 17 when the slip takes place between the roll sheet and the core tube S, when the roll diameter is at a minimum value, and when the roll diameter is at a maximum value.

Assuming that the number of slits provided in the slit plate 67 is "n", when the length of time for five pulses is measured, lengths of time t1, t2 and t3 are obtained respectively in the cases shown at the parts A, B and C of FIG. 10. With no slip taking place, the length of time "t" for generation of five pulses from the optical sensor 17 is at a value between the lengths of time t2 and t3. Then, a value computed in accordance with a formula of "$\omega=2\Pi\times5/nt$" (wherein $\omega$ represents the spool rotation speed) must be between the values $\omega min$ and $\omega max$.

In a case where the five-pulse generating time is measured and found to be the time t1, the computed value becomes "$2\Pi\times5/nt=\omega drive$", thus indicating occurrence of a slip. Incidentally, the five-pulses generating time is measured for the purpose of preventing the degradation of measuring accuracy due to the inconstancy of rotation.

Whether or not a slip takes place between the roll sheet and the core tube S is judged by making a check in this manner to find if the spool rotation speed $\omega$ is the value $\omega drive$. In actuality, the check is made for a state of "$\omega>1.15\times\omega max$", taking into consideration the measuring accuracy.

The method for detecting the occurrence or nonoccurrence of a slip between the roll sheet and the core tube S at the time of rewinding the roll sheet has been described above. However, it is conceivable that a slip might take place also while the sheet is being payed out from the roll in sending out the roll sheet or during the image forming process. The following describes how the slip is detected under such a condition.

In other words, with the sheet in process of being payed out, the rotation of the spool 60 is brought to a stop by the braking force on the spool 60 if a slip takes place. Therefore, a slip can be considered to have occurred by detecting the stop of rotation of the spool 60. A part D of FIG. 10 shows a pulse generating state obtained in that instance. As shown in the part D of FIG. 10, no pulse is generated in that instance. In actuality, a slip is considered to have occurred in a case where no pulse is detected, for example, approximately for the period of time t1 (if an image forming action is in process, for a period of time obtained by adding to the period of time t1 a length of time for which the sheet lays at rest during the main scanning).

Here, at the time of rewinding the sheet, a certain period of detection time (the above-stated five-pulse generating time) is necessary for deciding the occurrence of a slip. During this period of time, therefore, some slacken portion of the sheet happens to remain unwound on the roll within the roll sheet holder 10. However, since the detection time is only approximately the five-pulse generating time and is relatively short and the sheet conveying amount is only 50 mm or thereabout, the roll sheet holder 10 is arranged to include a space for the relatively small slacken portion of the sheet. Therefore, the arrangement does not bring about any problem in respect of an increase in size of the roll sheet holder 10.

When a slip is judged to have occurred between the roll sheet and the core tube S in the above-stated manner, the following measures are taken. If the slip takes place while the roll sheet is in process of feeding or rewinding, the operation of the apparatus is brought to a stop. The user of the apparatus is informed of the trouble with the roll sheet by a display or a warning sound. The user is thus urged, for example, to manually rewind the roll sheet or to replace the roll sheet.

If a slip takes place during an image forming process, the sheet might obliquely travel as the brake is not applied to the spool 60. However, if the apparatus is provided with a mechanism for detecting an oblique travel of the sheet, the image forming process can be carried on so long as no detection is made by the detecting mechanism. This arrangement is provided for preventing, as much as possible, the image in process of recording from being wasted.

After that, however, the user is informed of the abnormality of the roll sheet without rewinding the roll sheet. The above oblique travel detecting mechanism is formed, for example, by arranging an optical sensor adjacently to the recording head 46 which is driven for the main scanning in such a way as to be capable of detecting reflection light from the sheet. Then, the sheet position is always detected concurrently with the image formation, so that the presence or absence of an oblique travel of the sheet can be detected by the oblique travel detecting mechanism.

In the case of the second embodiment, the slit plate 67 is disposed at one end of the spool 60. The invention is, however, not limited to this arrangement. Since all parts from the torque limiter 86 to the spool core rod 61 are, theoretically, interlocked without fail, the slit plate 67 may be disposed at any part between them. For example, the slit plate 67 may be secured to the end surface of the spool driving gear 81 and the above-stated sensor may be disposed within the roll sheet driving unit 80. The arrangement for having the two parts within one and the same unit ensures accurate detection.

(Third Embodiment)

Figure 11:
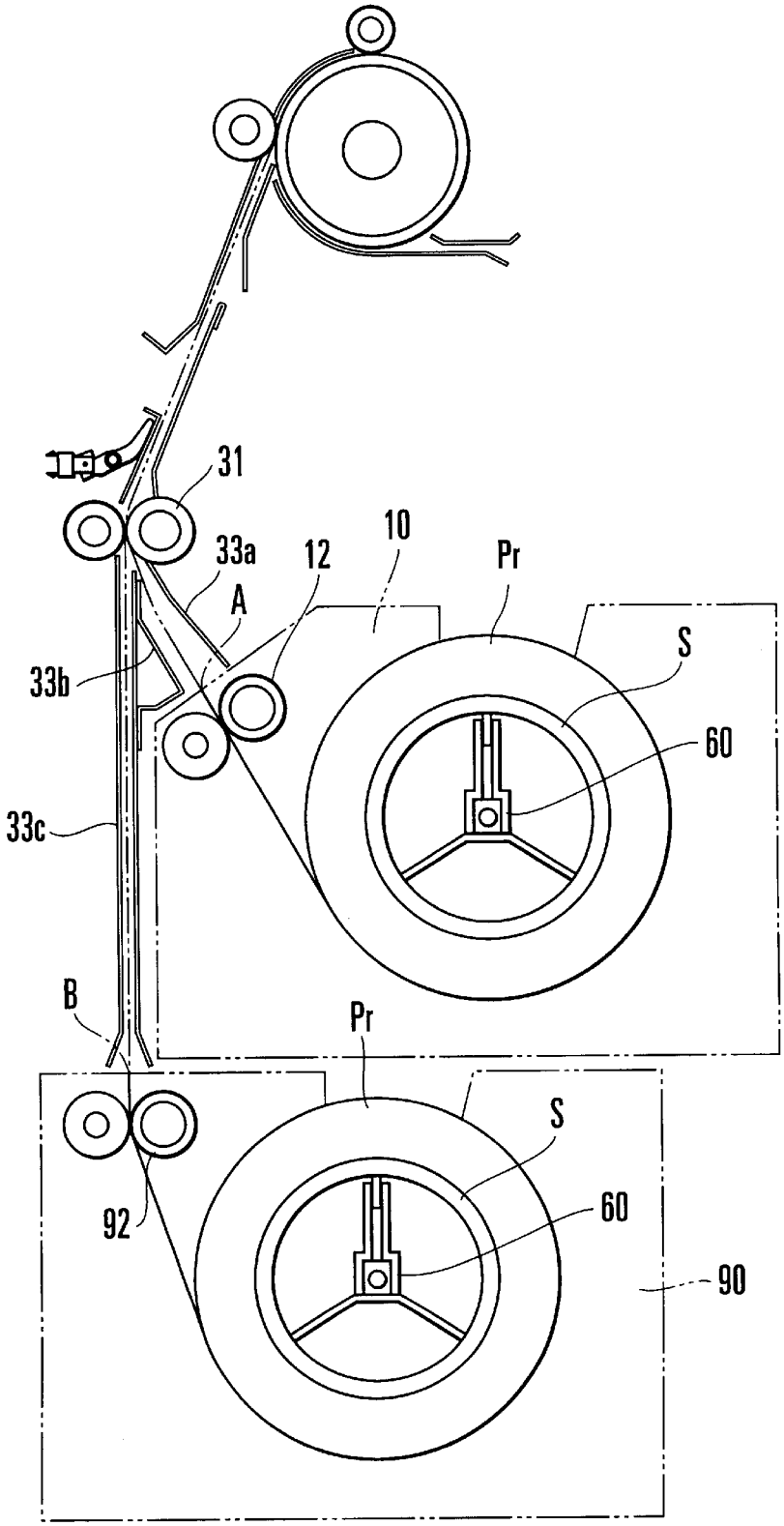
FIG. 11 is a sectional view showing a recording apparatus according to a third embodiment of the invention.

In each of the first and second embodiments, the roll sheet conveying device or the recording apparatus is arranged to be loaded with one roll sheet. However, it is a more salient feature of the invention that the roll sheet conveying device or the recording apparatus can be advantageously arranged to be loaded with a plurality of roll sheets. Referring to FIG. 11, the invention is advantageously applies, for example, to a case where a lower roll sheet holder 90 is disposed below an upper roll sheet holder 10, an upper sheet conveying roller 12 and a lower sheet conveying roller 92 are provided respectively for the holders 10 and 90, and the roll sheets are conveyed from the rollers 12 and 92 to the intermediate conveying roller 31 respectively through an upper sheet conveying guide 33*a* and a lower sheet conveying guide 33*b*.

The upper and lower roll sheet holders 10 and 90 are arranged respectively to be drawable frontward (to the right as viewed in FIG. 11) independently of each other, so that the roll sheets can be easily replaced.

It is an advantage of the third embodiment that, with roll sheets of different kinds or sizes separately stowed in the apparatus, the use of a roll sheet of one kind can be easily changed over to the use of a roll sheet of another kind without necessitating the trouble of replacing the roll sheet.

However, in the case of such an apparatus, the roll sheets always must be rewound to have their fore ends brought back to positions A and B after completion of the image recording action. This rewinding process is necessary for preventing each of the roll sheets from remaining inside of the body of the apparatus when the roll sheet holder is pulled out from inside of the body. Since which of the roll sheet holders would be pulled out by the user is hardly predictable, the fore ends of both of the roll sheets must be brought back to the positions A and B without fail at least when the operation of the apparatus comes to a stop.

Figure 12:
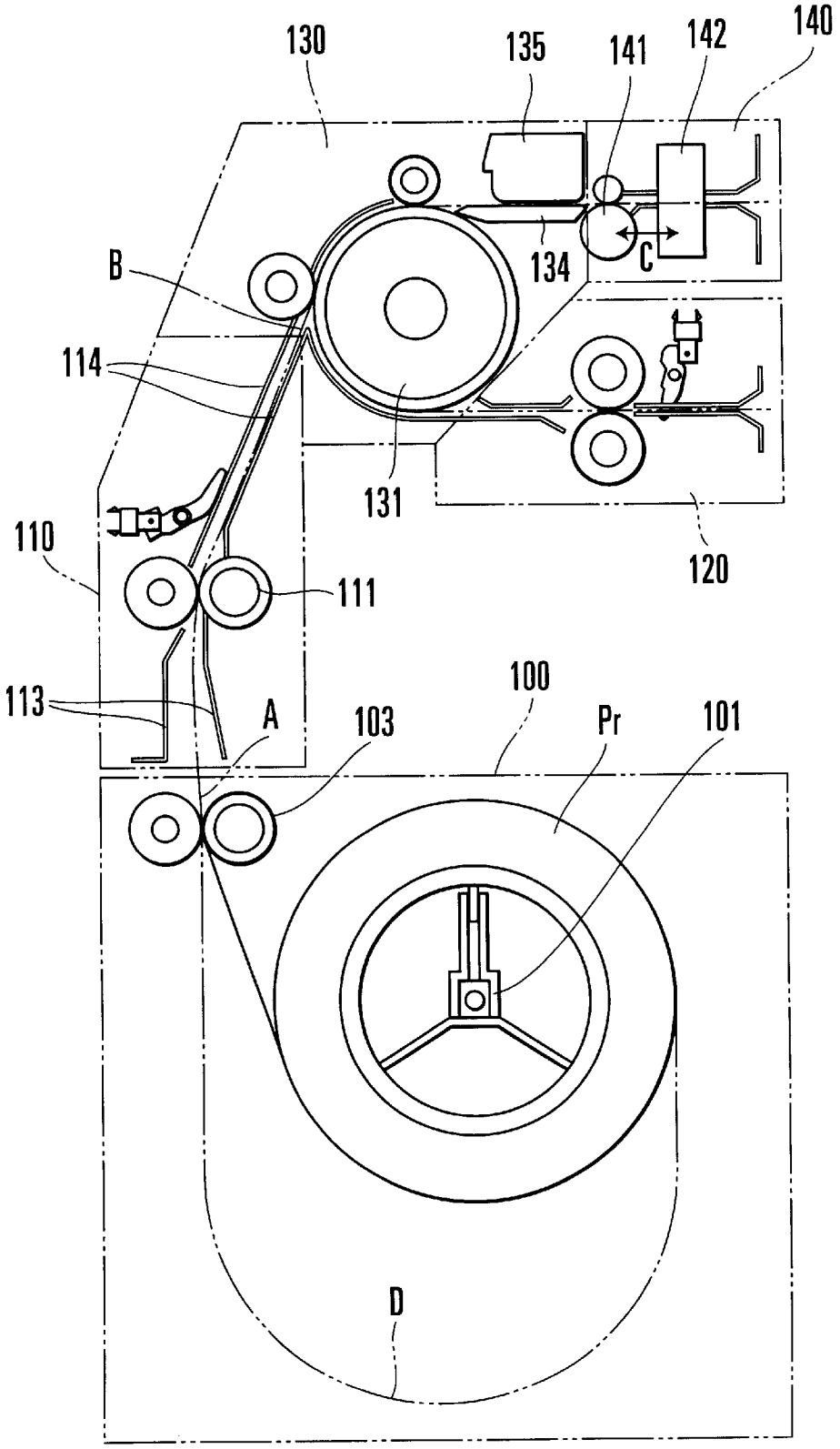
FIG. 12 is a sectional view showing, by way of example, the arrangement of a conventional roll sheet conveying device.

Then, since the lower roll sheet holder 90 is located right beneath the upper roll sheet holder 10, it is nearly impossible to provide a large space for allowing the sheet to be in a slacken state as shown in FIG. 12. Hence, the advantage of the arrangement for winding the sheet on the roll without allowing the sheet to slacken, as described in the foregoing description of the first and second embodiments, becomes more salient for the third embodiment.

In the case of each of the first, second and third embodiments described above, the invention is applied to the recording apparatus using the ink-jet recording method. However, the invention is not limited to the apparatus of that particular recording method but is applicable to the apparatuses of any other recording methods, such as a thermal recording method, an electrostatic recording method, etc. Further, while each embodiment disclosed is arranged to perform recording by causing the recording head to make a reciprocating motion and by intermittently feeding the sheet, the invention is applicable also to such an apparatus that is arranged to perform recording by continuously feeding and conveying sheets with its recording head in a fixed state.

According to the invention, as described in the foregoing, a rotation load (a braking force) is imposed on the spool in sending out (feeding) the roll sheet from the roll on the side of the spool (in causing the spool to be rotated through the sheet by the driving force of sheet conveying means), so that an oblique travel of the sheet is effectively prevented. In addition to that, in rewinding the sheet back to the spool (in winding the sheet on the roll by the driving force of the spool), any large rotation load is prevented from being imposed on the spool. Therefore, in rewinding the sheet, a load on the winding driving action can be prevented from increasing. Further, since any complex mechanism and any large space are not required, it is possible to effectively prevent the size and cost of the apparatus from increasing.

Further, according to the invention, the driving mechanism which drives the spool and the sheet conveying means in rewinding the sheet is arranged to drive the spool at such a speed that, throughout the whole process of rewinding the sheet, the speed of the spool and that of the sheet being taken up on the sheet roll wound around the spool are higher than the driving speed of the sheet conveying means in the rewinding direction. Further, the slip means, such as a torque limiter or the like, is arranged, according to the invention, to cause the spool to make a slip against the driving mechanism when the spool receives from the sheet a rewinding resisting force of a value larger than a predetermined value. The slip means enables the apparatus to rewind the sheet without any slackening, so that the roll sheet holder by which the roll of the roll sheet is supported through the spool can be prevented from becoming large in size. Besides, with an increase of a load on the sheet rewinding action prevented, the slip generating torque of the slip means can be set with an increased latitude, and the absolute value of the slip generating torque also can be lessened. The reliability of the parts and the apparatus thus can be enhanced.

The arrangement for detecting whether or not a slip takes place between the sheet and the core member and restraining the driving action of at least one of the sheet conveying means and the spool upon detection of the slip effectively prevents the sheet from slackening due to the slip between the sheet and the core member.

Further, the invention facilitates an improvement on the performance of such a multi-stage arrangement of the roll sheet conveying device that a plurality of roll sheets are mounted in a multi-stage manner.

What is claimed is:

1. A roll sheet conveying device, comprising:

a spool arranged to be rotatable while holding a roll-shaped sheet;

sheet conveying means for driving and conveying the sheet; and load generating means for generating a rotation load to act on said spool, wherein, when the sheet is sent out from said spool by driving said sheet conveying means, the rotation load of said load generating means is caused to act on said spool, and when the sheet is rewound onto said spool by driving said spool, the rotation load of said load generating means is prevented from acting on said spool; and wherein said spool is arranged to hold a core member of the roll-shaped sheet, and further comprising control means for detecting whether or not a slip takes place between the sheet and the core member in at least one of sending out the sheet and rewinding the sheet for, upon detection of the slip, restraining driving of at least one of said sheet conveying means and said spool.

2. A roll sheet conveying device according to claim 1, further comprising change-over means for causing the rotation load of said load generating means to act on said spool when the sheet is sent out from said spool by driving said sheet conveying means and for preventing the rotation load of said load generating means from acting on said spool when the sheet is rewound onto said spool by driving said spool.

3. A roll sheet conveying device according to claim 2, wherein said change-over means is a clutch arranged to connect said spool to said load generating means in sending out the sheet, and to disconnect said spool from said load generating means in rewinding the sheet.

4. A roll sheet conveying device according to claim 3, wherein a connection member which is connected to said load generating means is mounted on said spool in such a way as to be rotatable with respect to said spool, and wherein said change-over means is a one-way clutch disposed between said spool and said connection member.

5. A roll sheet conveying device according to claim 3, wherein said change-over means is a moving clutch arranged to move between such a position as to connect said load generating means to said spool and such a position as to disconnect said load generating means from said spool.

6. A roll sheet conveying device, comprising:

a spool arranged to be rotatable while holding a roll-shaped sheet;

sheet conveying means for driving and conveying the sheet; and load generating means for generating a rotation load to act on said spool, wherein, when the sheet is sent out from said spool by driving said sheet conveying means, the rotation load of said load generating means is caused to act on said spool, and when the sheet is rewound onto said spool by driving said spool, the rotation load of said load generating means is caused to lessen to act on said spool; and wherein said spool is arranged to hold a core member of the roll-shaped sheet, and further comprising control means for detecting whether or not a slip takes place between the sheet and the core member in at least one of sending out the sheet and rewinding the sheet for, upon detection of the slip, restraining driving of at least one of said sheet conveying means and said spool.

7. A roll sheet conveying device according to claim 1 or 6, further comprising a driving mechanism for driving said spool and said sheet conveying means in rewinding the sheet, said driving mechanism driving said spool at such a speed that a speed at which the sheet is taken up onto said spool by said spool and the sheet wound on said spool becomes higher than a driving speed of said sheet conveying means in a rewinding direction throughout the whole process of rewinding the sheet, and slip means for causing said spool to slip over said driving mechanism when said spool receives from the sheet a rewinding resisting force of a value exceeding a predetermined value.

8. A roll sheet conveying device according to claim 7, further comprising an input member arranged to be rotatable with respect to said spool and to receive a driving force to be transmitted to said spool, wherein said slip means is disposed between said spool and said input member and is arranged to cause said spool to slip with respect to said input member when said spool receives from the sheet a rewinding resisting force of a value exceeding the predetermined value.

9. A roll sheet conveying device according to claim 8, further comprising connecting/disconnecting means disposed between said spool and said input member for connecting said spool to said input member in rewinding the sheet and for disconnecting said spool from said input member in sending out the sheet.

10. A roll sheet conveying device according to claim 1 or 6, further comprising speed detecting means for outputting a pulse signal corresponding to a rotation speed of said spool, wherein said control means detects the slip when a period of the pulse signal outputted from said speed detecting means is not within a range of periods of the pulse signal outputted when no slip takes place.

11. A roll sheet conveying device, comprising:

a spool rotatably supported within a roll sheet holder in a state of holding a sheet from inside of a roll core on which the sheet is wound;

one or more conveying rollers arranged to convey the sheet;

a driving mechanism arranged to drive and rotate at least one of said spool and said one or more conveying rollers, a rotating direction of said driving mechanism being changeable to change over between conveying modes of conveying the sheet in a sending-out direction and in a rewinding direction;

a spool brake mechanism for applying a braking force to the rotation of said spool; and slip detecting means for detecting whether or not a slip takes place between the sheet and the roll core in at least one of sending out the sheet and rewinding the sheet, and control means for at least restraining or stopping an action of rewinding the sheet, when the slip has been detected by said slip detecting means, wherein, when the sheet is sent out from said spool by driving said one or more conveying rollers, the braking force of said spool brake mechanism is caused to act on said spool, and, when the sheet is rewound onto said spool by driving said spool, the braking force of said spool brake mechanism is prevented from acting on said spool.

12. A roll sheet conveying device according to claim 11, wherein said driving mechanism is arranged not to drive said spool in sending out the sheet and is arranged to drive said spool and at least one of said one or more conveying rollers in rewinding the sheet, a speed at which the sheet is rewound by driving said spool is set always not to be lower than a rewinding driving speed of said one or more conveying rollers, and a slip mechanism is disposed within said driving means to cause said spool to slip when a prescribed torque is generated.

13. A roll sheet conveying device according to claim 11 or 12, wherein said slip detecting means is a speed detecting means for detecting a rotation speed of said spool.

14. A roll sheet conveying device according to any one of claims 1, 6 and 11, wherein said spool is arranged to be a plurality of spools, and one of roll-shaped sheets respectively held by said plurality of spools is selectively sent out.

15. A roll sheet conveying device according to claim 14, wherein said plurality of spools are arranged vertically in a multi-stage manner.

16. A recording apparatus, comprising:

a roll sheet conveying device according to any one of claims 1, 6 and 11; and an image recording part arranged to record an image on the sheet sent out from said roll sheet conveying device.

17. A roll sheet conveying device according to claim 16, wherein said image recording part performs image formation onto the sheet by using a recording head of ink type which discharges ink drops toward the sheet.

* * * * *

UNITED STATES PATENT AND TRADEMARK OFFICE

CERTIFICATE OF CORRECTION

PATENT NO. : 6,435,446 B1
DATED : August 20, 2002
INVENTOR(S) : Kunihiko Matsuzawa It is certified that error appears in the above-identified patent and that said Letters Patent is hereby corrected as shown below:

Column 6,
Line 39, "dependents" should read -- depends --.

Signed and Sealed this

Fourth Day of February, 2003

JAMES E. ROGAN
*Director of the United States Patent and Trademark Office*